US009886877B2

(12) United States Patent
Declerck

(10) Patent No.: US 9,886,877 B2
(45) Date of Patent: Feb. 6, 2018

(54) ADJUSTABLE DISPLAY TILE FOR TILED DISPLAY

(71) Applicant: BARCO N.V., Kortrijk (BE)

(72) Inventor: Tom Declerck, Meulebeke (BE)

(73) Assignee: BARCO N.V., Kortrijk (BE)

( * ) Notice: Subject to any disclaimer, the term of this patent is extended or adjusted under 35 U.S.C. 154(b) by 0 days.

(21) Appl. No.: 15/317,761

(22) PCT Filed: Jun. 12, 2015

(86) PCT No.: PCT/EP2015/063150

§ 371 (c)(1),
(2) Date: Dec. 9, 2016

(87) PCT Pub. No.: WO2015/189377

PCT Pub. Date: Dec. 17, 2015

(65) Prior Publication Data

US 2017/0116895 A1 Apr. 27, 2017

(30) Foreign Application Priority Data

Jun. 13, 2014 (GB) ..... 1410637.1

(51) Int. Cl.
*G09F 9/302* (2006.01)
*G09F 9/33* (2006.01)

(52) U.S. Cl.
CPC ..... *G09F 9/3026* (2013.01); *G09F 9/33* (2013.01)

(58) Field of Classification Search
None
See application file for complete search history.

(56) References Cited

U.S. PATENT DOCUMENTS 5,805,117 A * 9/1998 Mazurek ..... G02F 1/13336 248/919
6,150,996 A 11/2000 Nicholson et al.
6,813,853 B1 11/2004 Tucker
8,384,616 B2 2/2013 Elliott et al.
8,840,284 B1 * 9/2014 Hochman ..... H05K 7/12 362/217.12
2002/0122134 A1 9/2002 Kalua
2005/0005487 A1 * 1/2005 Gray ..... G09F 21/04 40/452
2008/0266206 A1 * 10/2008 Nelson ..... G09F 9/33 345/1.3

(Continued)

FOREIGN PATENT DOCUMENTS

CN 201226214 Y 4/2009

OTHER PUBLICATIONS

International Search Report (ISR) dated Sep. 28, 2015, for PCT/EP2015/063150.

(Continued)

*Primary Examiner* — Antonio Xavier
(74) *Attorney, Agent, or Firm* — Bacon & Thomas, PLLC

(57) ABSTRACT

A display tile including a display board and a carrier board fastened together by the intermediary of a spacer and an adjusting means positioned between the spacer and the carrier board. The adjusting means engage in an opening in the carrier board. Also methods to adjust the distance between the top of a LED on a first surface of a LED board on a display tile and the back surface of the carrier board of the display tile.

25 Claims, 9 Drawing Sheets

(56) References Cited

U.S. PATENT DOCUMENTS

2010/0181456 A1* 7/2010 Declerck ..... G09F 7/18
248/346.01

OTHER PUBLICATIONS

Written Opinion dated Sep. 28, 2015, for PCT/EP2015/063150.
Second Written Opinion dated May 11, 2016, for PCT/EP2015/063150.
International Preliminary Report on Patentability (IPRP) dated Sep. 26, 2016, for PCT/EP2015/063150.

* cited by examiner

ADJUSTABLE DISPLAY TILE FOR TILED DISPLAY

The present invention pertains to the field of display apparatus, and in particular to a display tile, a tiled display apparatus comprising same, an apparatus for adjusting the geometry of a display tile, a method for adjusting the geometry of a display tile and a jig to facilitate the method for adjusting.

BACKGROUND OF THE INVENTION

The regularity of the seam existing between display tiles in a tiled display is important to avoid visual artefacts. The regularity of the seam is a function of the alignment of the display tile. Technique and apparatuses to align display tiles in tiled display are known in the art. For instance, U.S. Pat. No. 8,384,616B2 describes how clips and receptacles are used to align adjacent display tiles with a high accuracy.

These and similar tile alignment techniques suppose that the LED themselves are properly aligned with the tile itself.

The LEDs are soldered to a LED board and the LED board is fastened to a carrier board. Aligning the LED board and the carrier board is usually done by means of one or more reference pin(s). The reference pin(s) is/are used to align the LED board with references (e.g. a corner) of the carrier board. Unfortunately, there are tolerances on the position of the LEDs with respect to the LED board on which they are soldered and therefore, aligning the LED board perfectly with the carrier board by means of reference pins on the LED board does not mean that the LED themselves will be perfectly aligned with the carrier board. As a result, even if adjacent LED tiles are perfectly aligned, the relative position of the LEDs on different LED tiles may vary across a tiled display, thereby introducing visual artefacts.

Another problem not addressed by the clips and receptacles used in the prior art is the "z-coordinate" or position of the LED in a direction perpendicular to the plane of the LED board. Variation of the z position of the LED from tile to tile is the source of visual artefacts when the direction of a viewer's gaze is not along the normal to the plane of a tiled display.

What is needed is a solution to adjust the distance between the top of the LEDs on the LED board and a reference, e.g. the back surface of the carrier board.

It is known in the art to adjust the distance between two objects fastened together with e.g. screws and bolts by adding washers between the two objects. The problem with this technique is that varying the distance between two objects is only possible by multiples of the thickness of the washers if off-the shelf washers are used or that the washers have to be machined for every LED board in function of the actual distance between the LED and the LED board. This is neither practical nor economical.

SUMMARY OF THE INVENTION

A display tile according to the invention comprises a display board (1) and a carrier board (3) fastened together by the intermediary of a spacer (7) and an adjusting means (6) positioned between the spacer and the carrier board. The adjusting means (6) engages in an opening (33) in the carrier board. The adjusting means is for adjusting the distance between the display board and the carrier board, e.g. between the tops of LEDs on the display board (called the LED board) and the carrier board.

It is an advantage of the present invention that adjusting the relative position of LEDs on a LED board with respect to a carrier board will improve the alignment of tiles in tiled displays. Another advantage is that the seam between tiles will be as regular as possible, thereby avoiding the introduction of misalignments and their associated visual artefacts. These advantages can each or both be achieved without having to machine components specific to a LED board in function of the distance between the LEDs and the LED board.

The position of the adjusting means in the opening is changed until the distance between a first surface (61) of the adjusting means and a first surface (31) of the carrier board is the difference between a nominal distance (D0) and the sum of the distance between the top of LEDs (2) on the LED board (1) and a second surface (12) of the LED board, the length of the spacer (7) and the thickness of the carrier board (3). In other words, the distance between a first surface (61) of the adjusting means (6) and a first surface (31) of the carrier board (3) is equal to:

D0−(distance between the top of the LEDs and a second surface of the LED board)−(length of the spacer)−(thickness of the carrier board).

The nominal distance D0 is the desired distance between the top of the LEDs and the second surface (32) or back of the carrier board (3).

It is an advantage of that aspect of the invention that the position of the tops of the LEDs on the LED board with respect to the carrier board, and in particular a second face or back face of the carrier board will be determined with higher precision than if the distance of the LED board and the carrier board were only determined by spacers of fixed dimensions positioned between the LED board and the carrier board. Embodiments of the invention can allow the realization of tiled displays where the tops of the LEDs across the tiled display are substantially in the same plane thereby avoiding visual artefacts.

In another aspect of the invention, a sidewall (34) of the opening (33) in the carrier board can be perpendicular to the second surface (32) of the carrier board (3).

Furthermore, the sidewall (63) of adjusting means (6) can be parallel to the sidewall (34) of the opening (33) in the carrier board.

It is an advantage of that aspect of the invention that it will be easier to change the position of the adjusting means and to fasten it to the spacer from the back of the display tile.

In another aspect of the invention, the cross section of the adjusting means (6) fits in the opening (33). In other words, the distance between the sidewall of the opening and the sidewall of the adjusting means is less than e.g. 5% or less than e.g. 1% of a lateral dimension of the opening. In particular, the distance between the sidewall of the opening and the sidewall of the adjusting means can be small enough to introduce some friction between the sidewall of the opening and the adjusting means without making movement of the adjusting means in the opening impossible when e.g. a force of e.g. 1 N or between 1 and 10N or between 10 and 100N is applied on the adjusting means in a direction perpendicular to the second surface of the carrier board.

It is an advantage of that aspect of the invention that the movement of the adjusting means in the opening will be substantially restricted except in a direction perpendicular to (the second surface of) the carrier board thereby simplifying the task of the technician adjusting the relative position of the LED board and the carrier board. Furthermore, if the distance between the sidewall of the adjusting means and the sidewall of the opening is limited, it will be easier to dispense glue without spilling it beyond the adjusting means before it has hardened, or set or has been cured, in particular when the perpendicular to the carrier board is parallel to the local acceleration of gravitation, i.e. when the second face of the carrier board is facing "up".

In another aspect of the invention, the adjusting means (6) is fastened to the carrier board by glue dispensed on the second surface (62) of the adjusting means and the sidewall (34) of the opening (33).

It is an advantage of this aspect of the invention that it is possible to easily fix the distance between the top of the LED and the second surface of the carrier board of the display tile with a minimum of operations.

In a further aspect of the invention, the cross section of the adjusting means in the opening varies in a direction perpendicular to the carrier board. The distance between the sidewall of the adjusting means can for instance be greater in the upper part of the adjusting means (i.e. the part of the adjusting means closest to the second surface of the carrier board when the adjusting means is in the opening) than in the lower part of the adjusting means.

It is an advantage of this aspect of the invention that it will be easier to dispense glue on part of the sidewall of the adjusting means, thereby improving the fastening of the adjusting means to the carrier board.

In a further aspect of the invention, a fastening means 8 fastens the adjusting means to the spacer.

The fastening means can go through an opening in the adjusting means before mating with the spacer.

The fastening means can for instance be a screw.

In an alternative aspect of the invention, the fastening means 8 is an integral part of the adjusting means. The fastening means can be a threaded extension that extends from the first surface of the adjusting means in a direction perpendicular to that surface of the adjusting means to mate with a threaded opening in the spacer. The second surface of the adjusting means can then be a driving surface, i.e. it can be slotted, the slot (65) allowing interaction of the second surface (62) with a tool like a screwdriver.

It is an advantage of that aspect of the invention that it will further limit the number of operations required to fasten the adjusting means to the spacer.

According to an aspect of the invention, there is provided a method to adjust the distance between the tops of the LEDs on a display tile and the back surface of the carrier board of the display tile. It is an advantage of the proposed method that it will compensate for the tolerances affecting the position of the LEDs, the thickness of the LED board, the length of the spacers and the thickness of the carrier board.

The LED board and the carrier board can be positioned parallel to each other (the first surface of the carrier board facing the second surface of the LED board), the distance between the tops of the LEDs and the second surface or back surface of the carrier board being taken equal to the desired distance. In other words, the tops of the LEDs on the LED board are positioned in a first reference plane; the second surface of the carrier board is positioned in a second reference plane parallel to the first plane, the second surface of the carrier board facing away from the LED board; the distance between the first reference plane and the second reference plane being the desired or nominal distance between the tops of the LEDs and the second surface of the carrier board. The opening(s) in the carrier board aligned with the spacer(s) on the LED board.

The adjusting means is moved in the opening in the carrier board until a first surface of the adjusting means contacts the spacer.

The adjusting means and the spacer are fastened together. Glue is dispensed in the opening on the sidewall of the opening and on a second surface of the adjusting means. The glue is then allowed to harden, to set or to cure to fasten the adjusting means to the carrier board at the position where the adjusting means compensates for the tolerances affecting the position of the LEDs with respect to the carrier board in a direction perpendicular to the carrier board.

Fixing the distance between the top of the LEDs and the second surface of the carrier board can be facilitated by using a jig manufactured with better tolerances than the LED board and the carrier board.

The jig has a first surface or reference surface. Sidewalls extend from the first surface of the jig. If the tolerance on the thickness of the carrier board is sufficiently small to be neglected, the top of the sidewalls serves as support or stop for the carrier board that is positioned in parallel with the reference surface. The LED board is positioned with the LEDs in contact with the reference surface.

The height of the sidewalls can be chosen such that when the sidewalls are in contact with the carrier board, the distance between the second surface of the carrier board (facing away from the reference surface) and the reference surface is equal to the nominal distance or desired distance between the tops of the LEDs on the LED board and the second surface of the carrier board. The position of the adjusting means in the opening of the carrier board is modified until a first surface of the adjusting means contacts the spacer. The adjusting means and the spacer are then fastened. Glue is dispensed in the opening to fasten the adjusting means to the carrier board and to fix its position in the opening, thereby guaranteeing that when the carrier board and LED board are taken out of the jig, the distance between the second surface of the carrier board and the tops of the LEDs is equal to the nominal or desired distance.

If the tolerances on the thickness of the carrier board cannot be neglected, the sidewalls of the jig preferably have a step. The distance between the top of the outermost part to which the sidewall extends and the reference surface (in a direction perpendicular to the reference surface) is equal to the nominal or desired distance. The distance between the top of the innermost part of the sidewall and the reference surface is less than the nominal or desired distance minus the nominal thickness of the carrier board.

A flexible material (like e.g. elastomer, rubber, such as silicone rubber, or a foam such as polyurethane foam) is positioned between the top of the innermost part of the sidewall and the carrier board. The thickness of the flexible material is chosen so that pressure must be applied to the carrier board to make the second surface of the carrier board flush or coplanar with the top of the outermost part of the sidewall of the jig. When the second surface of the carrier board is flush with the top of the outermost part of the sidewall of the jig, the distance between the tops of the LED and the second surface of the carrier board is the nominal or desired distance. The position of the adjusting means in the opening of the carrier board is modified until a first surface of the adjusting means contacts the spacer. The adjusting means and the spacer are then fastened. Glue is dispensed in the opening to fasten the adjusting means to the carrier board and to fix its position in the opening, thereby guaranteeing that when the carrier board and LED board are taken out of the jig, the distance between the second surface of the carrier board and the tops of the LEDs is equal to the nominal or desired distance.

The present invention in other aspects relates to a display apparatus, a tiled display apparatus comprising display tiles, an apparatus for adjusting the geometry of a display tile, to a jig to facilitate the method for adjusting a relative position of the display board with respect to the carrier board.

BRIEF DESCRIPTION OF THE DRAWINGS

FIG. 5*b* shows a cross section of a display tile when the top of the LED is farther away from the first surface 11 of LED board 1 than nominal and not compensated for.

FIG. 6*b* shows a cross section of a display tile when the top of the LED is closer the first surface 11 of LED board 1 than nominal is not compensated for.

DETAILED DESCRIPTION OF THE INVENTION

Figure 1:
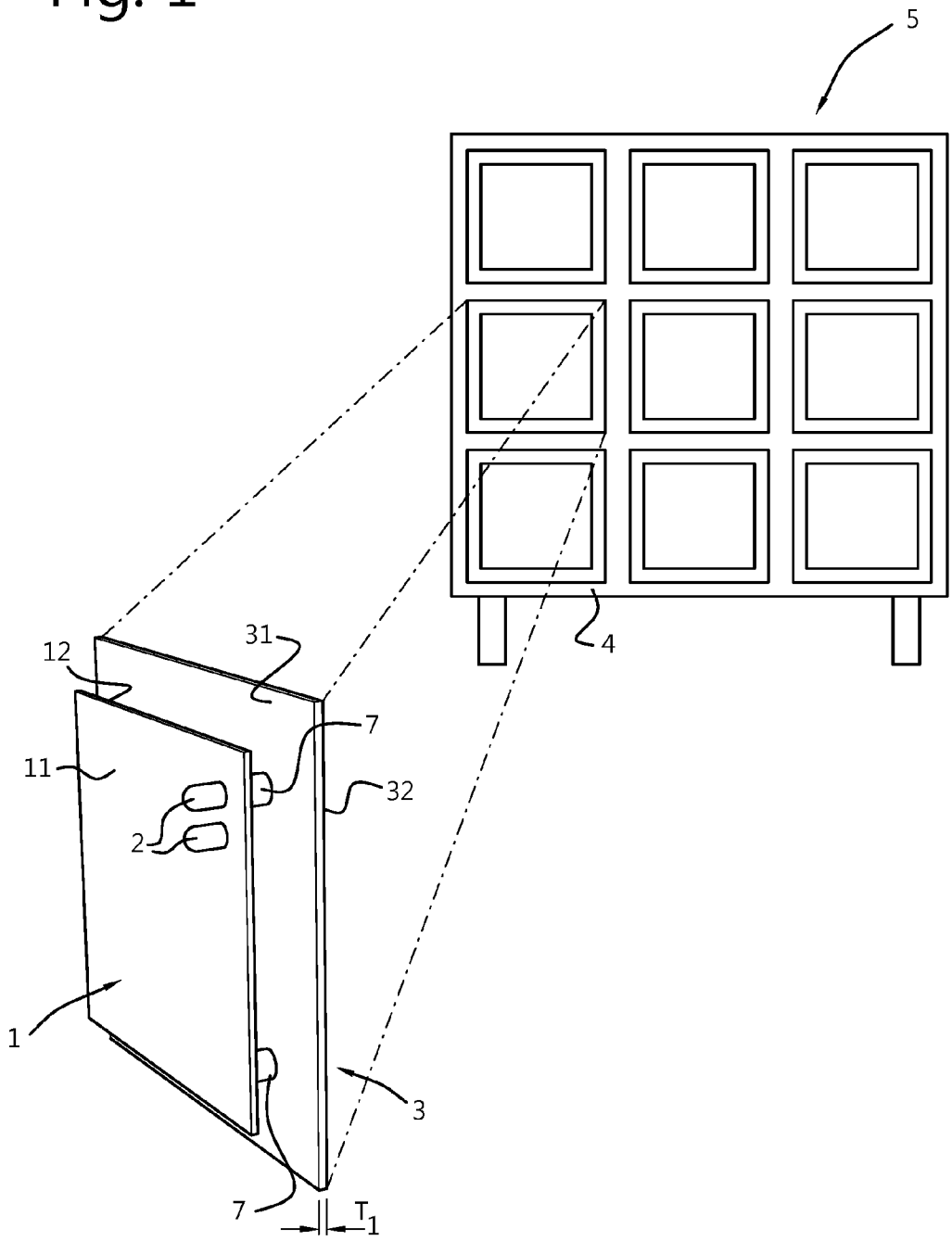
FIG. 1 shows a perspective view of a display tile according to an embodiment of the invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

While the description will be done for a LED display, the invention also applies to display tile where an image forming element (e.g. a liquid crystal panel) or a set of image forming elements (e.g. OLED) on a display board must be aligned with a carrier board. In the following any reference to LED (light emitting diode) can be replaced with OLED (organic light emitting diode). In the following a display board will be described with reference to an LED display, and hence the display board will be called LED board, as an example. However, the display board is not limited to an LED board but includes other types of boards such as display boards with OLED emitters.

A LED board 1 consists of a printed circuit board (PCB) bearing electrically conducting tracks e.g. copper tracks that connects Light Emitting Diodes 2 (LED) to various electronic components (like e. g. current drivers, power supply contacts etc . . . ). As seen on FIG. 1, The LED board 1 has a first face 11 and a second face 12 that are parallel. The LEDs are mounted on the first face 11 of the LED board. The tolerance on the vertical position of the LED 2 with respect to the first face 11 is the same for all LEDs mounted on the same LED board 1. The LEDs can be surface mount devices or through-hole devices.

The LED board 1 is fastened to a carrier board 3. The carrier board 3 will be the mechanical interface between the LED board and a support structure 4 of a tiled display 5.

The carrier board 3 has a first face 31 and a second face 32. The first face 31 and the second face 32 are substantially parallel to each other. The distance between the first face 31 and the second face 32 is the thickness T1 of the carrier board 3. The first face 31 (the front or front face of the carrier board 3) will be closest to the LED board 1 when the LED board 1 and the carrier board 3 are assembled. The second face 32 (the back or back face of the carrier board 3) will be closest to the support structure 4 when the LED board 1 and its associated carrier board 3 are fastened to the support structure 4.

The carrier board 3 has at least one opening 33 extending from the first face 31 to the second face 32. The opening 33 has sidewalls 34 that are preferably perpendicular to the first face 31 and the second face 32 of the carrier board 3. The intersection of the sidewalls 34 and the first face 31 is a curve C1. C1 is preferably a circle but other curves such as arcuate are possible.

Figure 2:
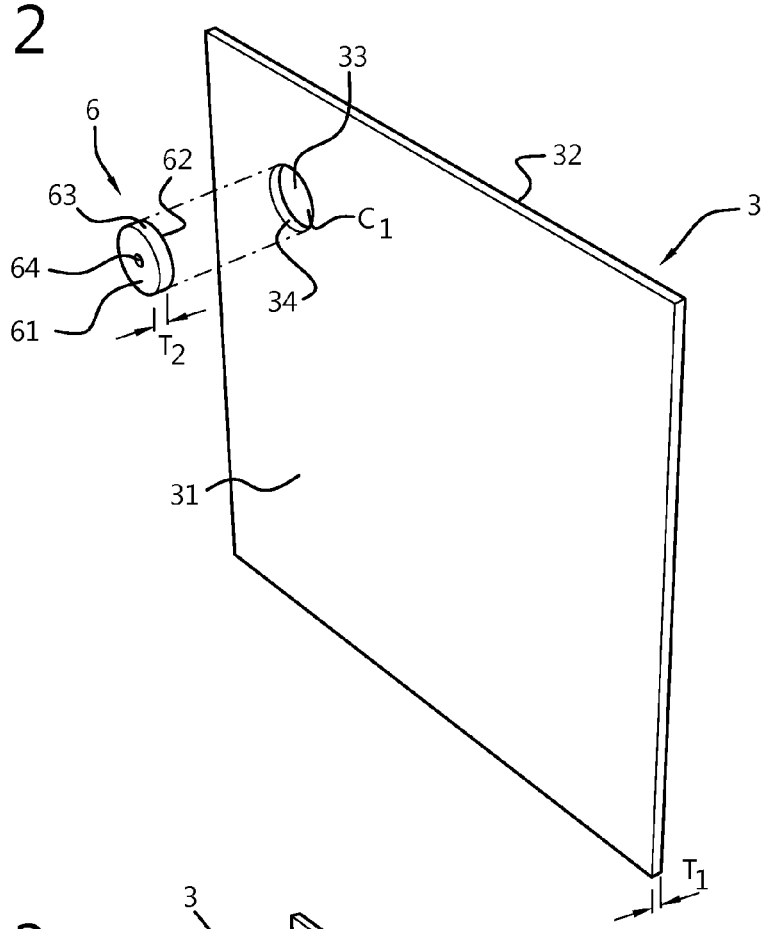
FIG. 2 shows a perspective view of the carrier board and the adjusting means according to an embodiment of the invention.
Figure 7A:
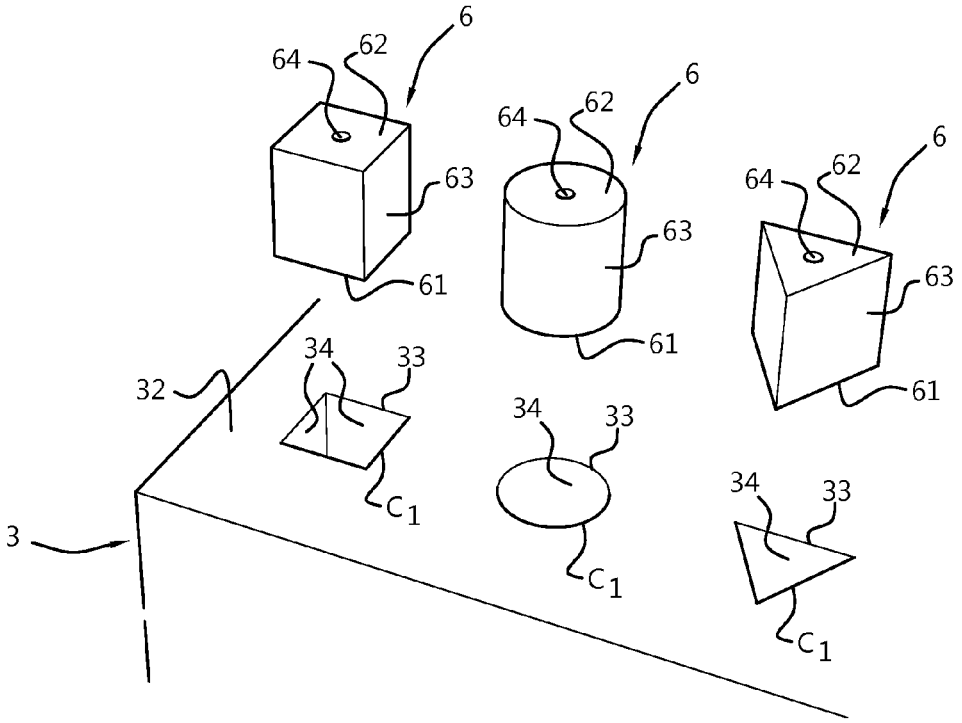
FIG. 7*a* shows examples of geometries for the adjusting means 6 and the opening 33 according to an embodiment of the invention.

An adjusting means 6 has a first face 61 and a second face 62. The first face 61 and the second face 62 are preferably substantially parallel to each other. The adjusting means 6 has a third face 63 extending from the first face 61 to the second face 62. The third face is preferably perpendicular to the first face 61 and the second face 62. The adjusting means 6 is positioned in the opening 33 in the carrier board 3, the first face and second face 61 and 62 of adjusting means 6 being parallel to the first and second face 31 and 32 of the carrier board 3. For instance, if the opening 33 is cylindrical and the curve C1 is a circle of radius R1 as on FIG. 2, the cross section of the adjusting means 6 is preferably a circle C2 with a radius R2 equal to or slightly smaller than the radius R1. Other cross sections are possible for the adjusting means 6, some examples of which are given on FIG. 7*a* where the curve C1 is a curve or a square. In some cases it may be advantageous that the thickness T2 of the adjusting means 6 is less than the thickness T1 of the carrier board 3 (in particular at the level of the opening 33).

Figure 7B:
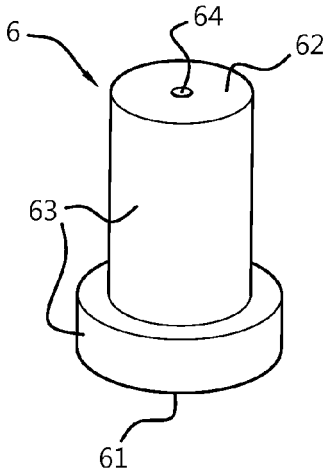
FIGS. 7*b* and 7*c* show an example of adjusting means 6 where the cross sections in a first part and a second part of the adjusting means are different according to an embodiment of the invention.
Figure 7C:
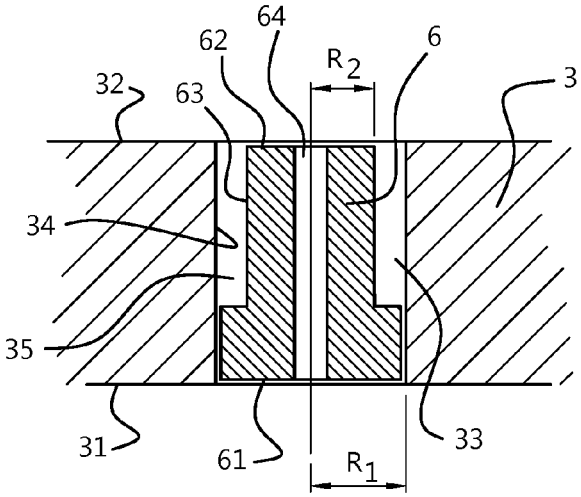

The cross section of the adjusting means 6 by a plane parallel to first face 61 can vary from the first surface 61 to the second surface 62. In particular, the cross section of adjusting means 6 can decrease close to the second surface. In particular as illustrated on FIGS. 7*b* and 7*c*, the cross section can have an area equal to that of the first surface 61 in a first part of the adjusting means close to first surface 61 and can have a second area less than the area of surface 61 in a second part of the adjusting means adjacent to surface 62. If the opening 33 determines a circle in the second surface 32 of the carrier board 3, the adjusting means can for instance be the combination of two circular right cylinders:

a first cylinder of radius R3 (not shown—slightly smaller than R1) in a first part delimited on one side by the first surface 61 and a second cylinder of radius R2 in a second part delimited on one side by the second surface 62.

The space 35 between the sidewall 34 of the opening 3 and the sidewall 63 of the adjusting means 6 along the second part of the adjusting means 6 is thereby larger and it is easier to dispense glue in the space 35 to fasten the adjusting means to the carrier board 3. At the same time, the first part of the adjusting means will prevent the glue from spilling onto the spacer and the LED board. It is advantageous to have a space 35 between to dispense glue on both a portion of the sidewall 34 of the opening 33 and a portion of the sidewall 63 of the adjusting means 6. Indeed, by increasing the surface glued, the fastening of the adjusting means 6 to the carrier board 3 is improved.

At least one spacer 7 is fastened to the second face 12 of the LED board 1. The position of the spacer 7 corresponds to the position of the opening 33 in the carrier board 3 when the LED board 1 is positioned parallel to the carrier board 3, the second face 12 of the LED board 1 facing the first face 31 of the carrier board 3. The length of spacer 7 on different LED boards is less variable than the distance D1 between the top of LED 2 and the first face 11 of LED board 1 on different LED boards. The spacer 7 is usually cylindrical and is of the female type, i.e. it has an opening that can accommodate a fastening element 8.

At least one fastening element 8 is used to fasten the carrier board 3 to the LED board 1. The fastening element 8 is for instance a screw that fits in the opening 71 of the spacer 7.

Figure 3:
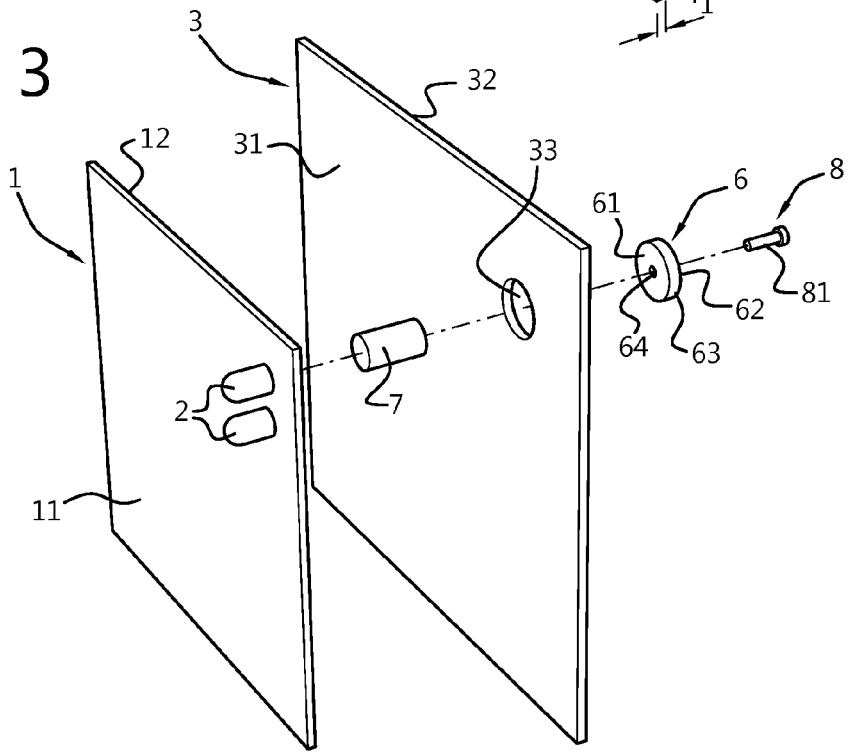
FIG. 3 shows an exploded view of a display tile according to an embodiment the invention.

As seen on FIG. 3, the fastening element 8 goes through an opening 64 of adjusting means 6 from the second face 62 to the first face 61, preferably perpendicularly to the faces 61 and 62. The opening 64 is preferably unthreaded, the fastening element 8 can move through it without excessive resistance.

A head 81 of fastening element will stop the progression of fastening element 8 through adjusting means 6. For instance, if the fastening element 8 is a screw, the head of the screw will press against the second face 62 of the adjusting means 6 and stop the progression of the screw 8 even if a force is exerted on the screw.

As the screw 8 is screwed in the female spacer 7; the screw 8 moves closer to the second face 12 of LED board 1. The screw 8 has a length such that it can be screwed in the spacer 7 until the first face 61 of adjusting means 6 is in contact with spacer 7. For instance, the length L1 of the screw 8 is less than the thickness T2 of the adjusting means 6 and the length L2 of the female opening of the spacer 7 combined (L1<T2+L2). When the screw 8 cannot go any deeper into the spacer 7, the adjusting means 6 is fastened to the carrier board 3. This can be done by dispensing glue 9 inside the opening 33, preferably from the second surface 32, the glue 9 contacting at least the second surface 62 of adjusting means 6 and the sidewall 34 of the opening 33 in the carrier board 3. Depending on the cross section of adjusting means 6, the glue may go deeper into the opening 33 and contact the sidewalls 63 of adjusting means 6.

Alternatively, the opening 64 of adjusting means 6 can be threaded and the spacer 7 can have a male threaded part 72 instead of a threaded opening 71. Adjusting means 6 is screwed over the male threaded part 72 until it cannot slide any further into the opening 33. Glue 9 is then dispensed in the opening 33 on the sidewall 34 and the second face 62 of adjusting means 6 to fasten the carrier board 3 and the adjusting means 6 together.

The glue 9 is chosen in function of the material of the carrier board 3 and the adjusting means 6. The glue 9 is preferably a fast curing glue.

There is preferably more than one spacer 7 distributed evenly across the second face 12 of the LED board 1. For each spacer 7*b*, there will be a corresponding opening 33*b* in the carrier board 3 and a corresponding adjusting means 6*b*. The position in an opening 33*b* of the adjusting means 6*b* associated with a particular spacer 7*b* can be the same for all the openings and their associated adjusting means. This will be the case if the thickness of the LED board 1, the thickness of the carrier board 3 is constant across the board and the length of the spacers 7, 7*b* . . . is the same for spacer 7, 7*b* . . . .

Figure 8A:
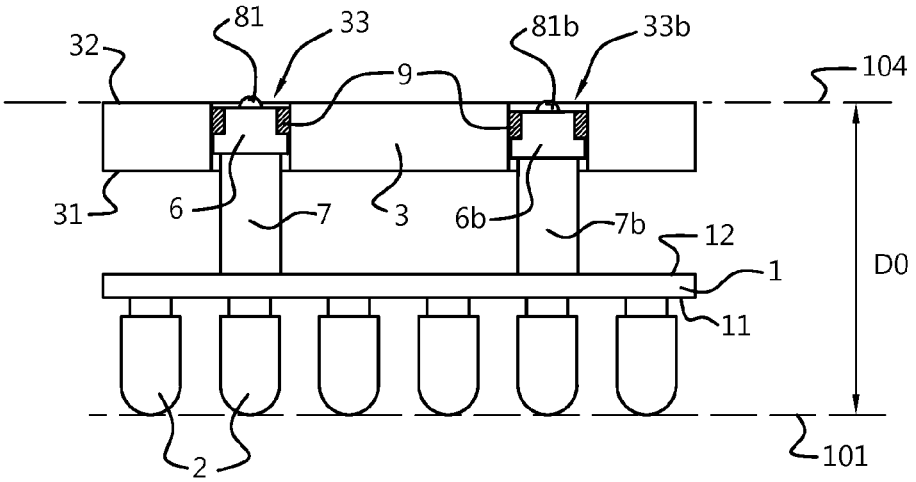
FIGS. 8*a*, 8*b* and 8*c* show a cross section of a display tile according to embodiments of the invention where the adjusting means 6 and 6*b* compensate for an irregular LED board, spacers 7 and 7*b* of different lengths and an irregular carrier board respectively.
Figure 8B:
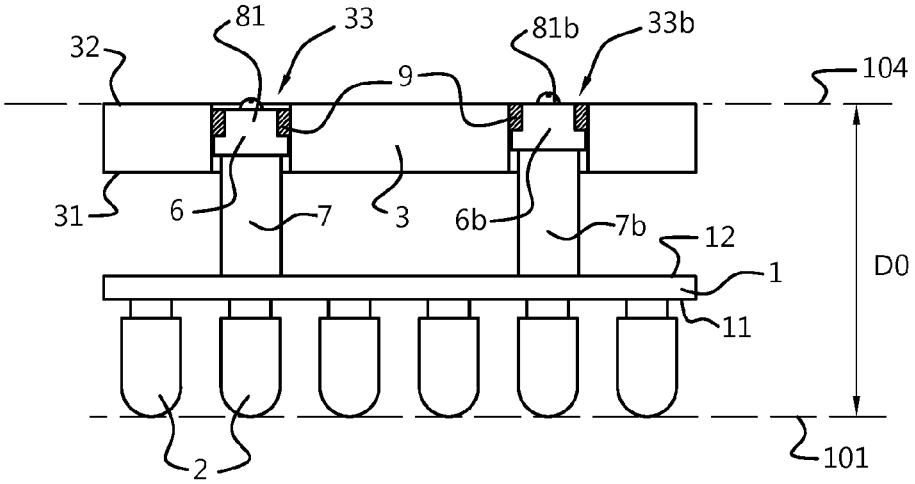
Figure 8C:
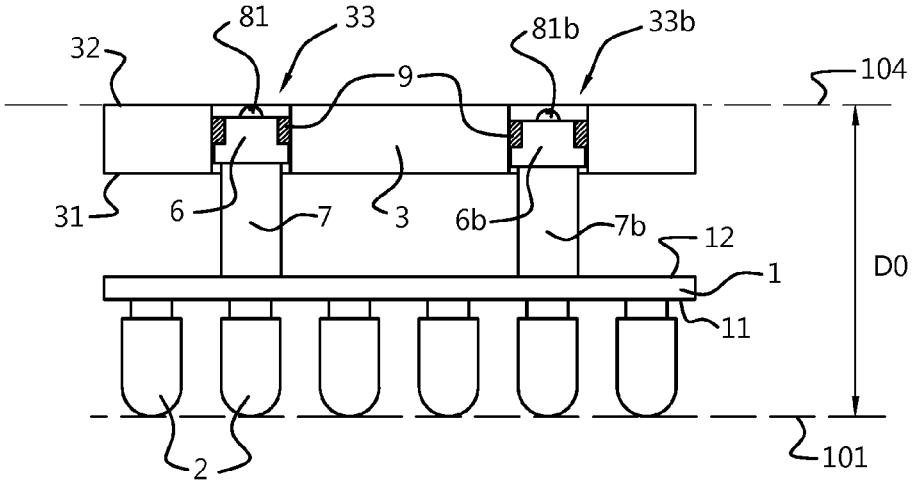

If the thickness of the LED board 1 and/or the carrier board 3 is not constant across the board and/or the length of the spacers is not the same for the spacers 7, 7*b* . . . due to tolerances, the position of adjusting means 6, 6*b* . . . in their corresponding opening 33, 33*b* . . . can be different. This is illustrated on FIG. 8*a* (thickness of the LED board not constant across the board), FIG. 8*b* (spacers 7 and 7*b* have different lengths) and FIG. 8*c* (thickness of the carrier board not constant across the board). The adjusting means 6 can thus compensate for tolerances affecting different components of the display tile.

The area of opening 33 in the carrier board 3 is preferably larger than the area of a cross section of the spacer 7 by a plane parallel to the first and second faces of the carrier board. This is to ensure that the spacer 7 can penetrate the opening 33 if made necessary by the tolerance on the position of the LED 2 with respect to the first surface 11 of the LED board 1.

Figure 9A:
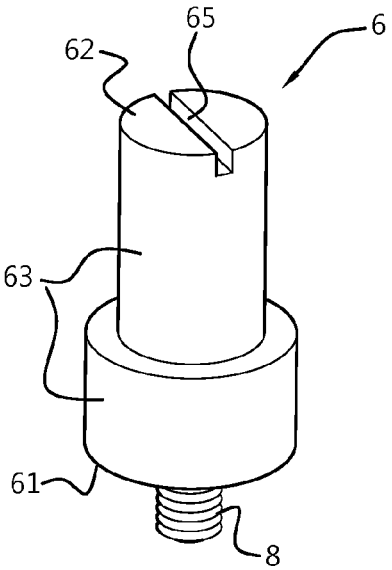
FIG. 9 shows a perspective view and a cross section of an example of adjusting means with an integral fastening means according to an embodiment of the invention.
Figure 9B:
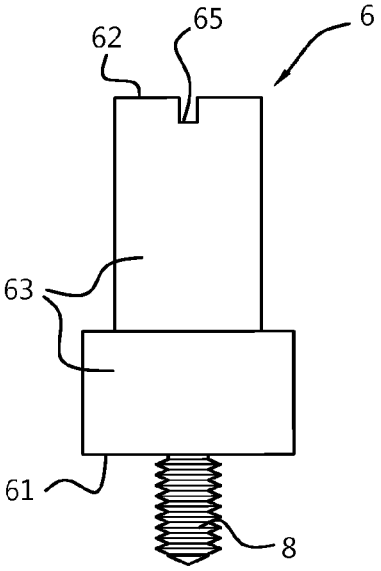

Alternatively to a screw, the fastening means 8 can be an integral part of the adjusting means 6. As illustrated on FIG. 9, the fastening means 8 can be a threaded extension that extends from the first surface 61 of the adjusting means 6 in a direction perpendicular to that surface of the adjusting means 6 to mate with a threaded opening in the spacer 7. The second surface 62 of the adjusting means can then be a driving surface, i.e. it can be slotted, a slot 65 in second surface 62 allowing interaction of the second surface 62 with a tool like a screwdriver.

Alignment of the LEDs 2 with carrier board 3 can be facilitated by the use of a jig 10.

The jig has at least a first "bottom" part 10A. The bottom part 10A has a first surface 101. The first surface 101 has an area sufficient to accommodate all the LED on the LED board 1.

The jig can have a second "top" part 10B. The top part 10B will help position the carrier board with respect to the LED board 1.

The bottom part 10A has sidewalls 102 extending above its first surface 101. The rim of the first surface 31 of the carrier board 3 can contact a surface 103 of the sidewalls 102. The distance between the first surface 101 of the bottom part 10A and the second surface 32 of the carrier board 3 corresponds to the desired distance D0 between the tops of the LED 2 on the LED board 1 and the second surface 32 of the carrier board 3. In this first embodiment of the jig 10, the distance between the surface 103 and the first surface 101 is equal to the nominal distance D0 minus the thickness of the carrier board 3.

In general, when the tolerance on the thickness of the carrier board is not negligible, a second embodiment of the jig 10 is used wherein the sidewalls 102 have a second surface 104 along an outer edge of the sidewalls 102. The second surface 104 is parallel to the first surface 101 (the reference surface). The distance between the second surface 104 and the first surface 101 is equal to the nominal distance D0 desired between the top of the LEDs 2 and the second surface 32 of the carrier board 3. In this case, the distance between the surface 103 and the first surface 101 is less than the nominal distance D0 minus the nominal thickness of the carrier board 3.

An elastic material 105 like e.g. elastomer or rubber covers the surface 103 of the sidewalls. The thickness of the elastic material 105 is determined in function of its elasticity, the distance between the first surface 103 and the second surface 104 and the nominal thickness of the carrier board 3. Once positioned in the jig, the carrier board 3 is in contact with the elastic material 105 and a force is applied on one or more points of the second surface 32 of the carrier board 3 to bring the second surface 32 of the carrier board at the same level as the second surface 104 of the sidewall 102. This is evaluated in first instance at the periphery of the carrier board 3. Alternatively, a top part 10B of the jig 10 is fastened to the bottom part 10A of the jig by means of e.g. screws. Pressure is applied to the carrier board either directly by the top part or by means of screws fitting in threaded openings in the top part. Once the second surface 32 of the carrier board 3 is flush with the second surface 104 of the sidewalls, the distance between the top of the LEDs 2 (in contact with the reference surface 101) and the second surface 32 of the carrier board 3 is equal to the nominal or desired distance. Openings in the top part 10B of the jig permit access to the openings 33, 33*b* . . . in the carrier board 3.

Figure 10:
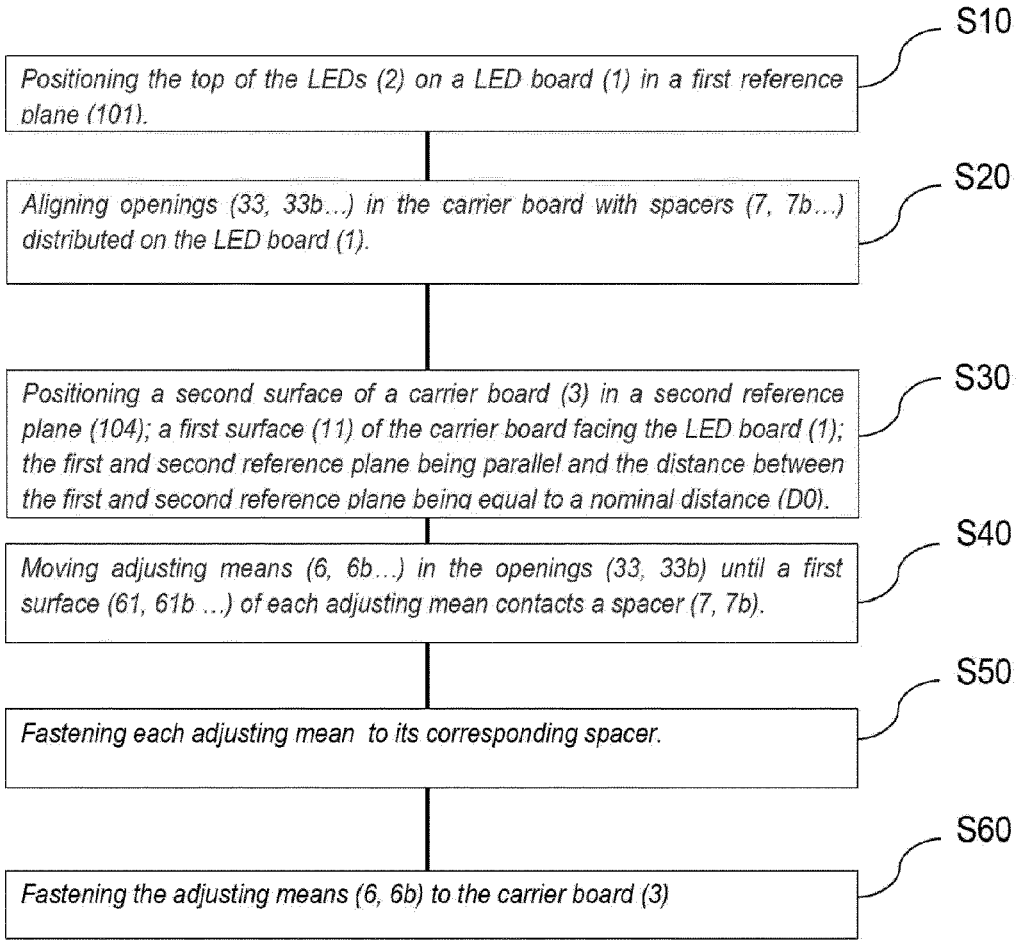
FIG. 10 shows an example of method to adjust a display tile according to an embodiment of the invention.

The method of assembling the LED board 1 to the carrier board 3 in order to obtain the desired distance between the top of the LED 2 and the second surface 32 of the carrier board 3 will now be detailed. An example of the method is given on FIG. 10.

In a first step S10 the tops of LEDs 2 on the LED board 1 are positioned in a first reference plane 101.

With help of the jig 10, this is done by positioning the LED board 1 on the bottom part 10A of the JIG 10 with the tops of LEDs 2 in contact with the first surface 101.

In a second step S20, the openings (33, 33*b* . . . ) in the carrier board are aligned with the spacers (7, 7*b* . . . ).

In a third step S30, the second surface 32 of the carrier board 3 is positioned in a second reference plane 104; the first surface 31 of the carrier board 3 facing the second surface 12 of the LED board. The first and second reference planes are parallel and the distance between the first and second reference plane is equal to a nominal distance D0.

When using the first embodiment of the jig, positioning the second surface 32 of the carrier board in the second reference plane in step S20 is done by bringing the first surface 31 of the carrier board in contact with the surface 103 of the sidewall 102.

When using the second embodiment of the jig 10, the first surface 31 of the carrier board 3 is brought into contact with the elastic material 105 and pressure is applied to the carrier board until the second surface 32 of the carrier board in the second reference plane corresponding to the second surface 104 of the sidewall 102 of the jig.

Steps 20 and 30 can be interchanged. For instance when only part 10A is used, the carrier board can first be positioned on the surface 103 to be at the correct distance and then slid in the plane of surface 103 to align openings 33, 33*b* . . . with the corresponding spacers 7, 7*b* . . . .

In a fourth step S40, an adjusting means 6 is positioned in the opening 33 and moved in the opening in a direction perpendicular to the second surface 32 until a first surface 61 of the adjusting means contacts a spacer 7. This operation is repeated for every spacer 7 that can be accessed by an opening 33 in the carrier board.

In a fifth step S50, the adjusting means 6 is fastened to the spacer 7. This operation is repeated for every spacer 7 that can be accessed by an opening 33 in the carrier board.

When using e.g. a screw 8 to fasten the adjusting means 6 to the spacer 7, the opening 71 in the spacer 7 and the opening 64 in adjusting means 6 are aligned. Screw 8 is engaged in opening 64 and screwed in threaded opening 71 of the spacer 7 until the head 81 of screw 8 contacts the second surface 62 of adjusting means 6 and presses adjusting means 6 against the spacer 7.

In a sixth step S60, the adjusting means 6 is fastened to the carrier board 3. This can be done by dispensing glue 9 in the opening 33 of the carrier board. The operation is repeated for each spacer on the LED board 1 facing an opening in the carrier board 3.

The distance between the tops of the LEDs and the second face of the carrier board is now fixed and equal to D0.

Alternatively, step S50 and step S60 can be interchanged. In particular, when the fastening means 8 is an integral part of the adjusting means as is the case on FIG. 9; the first surface 61 of the adjusting means 6 will come in contact with the spacer 7 after the fastening means 8 is completely engaged in the threaded opening of spacer 7. In other words, the first surface 61 will contact the spacer 7 as a result of fastening the adjusting means 6 to the spacer 7.

If glue is used to fasten the adjusting means to the carrier board and if a screw going through an opening 64 of the adjusting means is used to fasten the adjusting means and the spacer, it may be advantageous to fasten the adjusting means and the spacer before dispensing the glue. Indeed, in that case, the opening 64 being then obstructed by the screw 8, the glue 9 will not spill into the opening 64.

Figure 4:
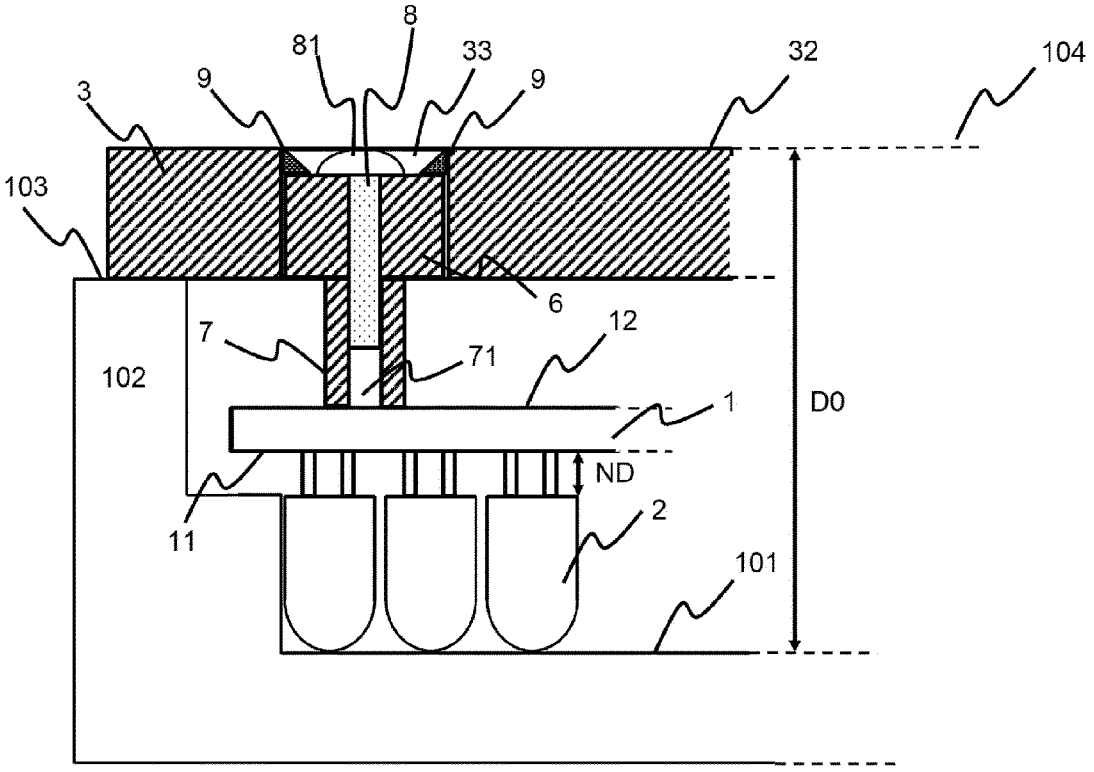
FIG. 4 shows a cross section of a display tile according to an embodiment of the invention by a plane perpendicular to the display tile when the tolerances are negligible.

FIG. 4 to FIG. 6 show three typical situations and the resulting position of the adjusting means 6 to fasten LED board 1 to carrier board 3.

In FIG. 4, the tops of the LEDs 2 are at a nominal distance from the first surface 11 of LED board 1.

Figure 5A:
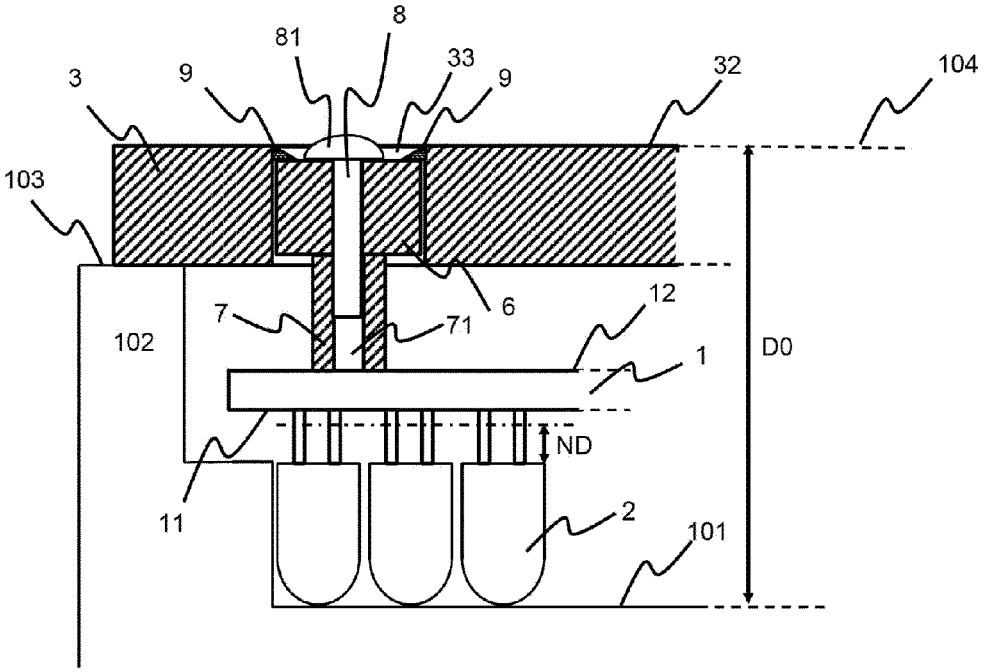
FIG. 5*a* shows a cross section of a display tile according to an embodiment of the invention when the top of the LED is farther away from the first surface 11 of LED board 1 than nominal.
Figure 5B:
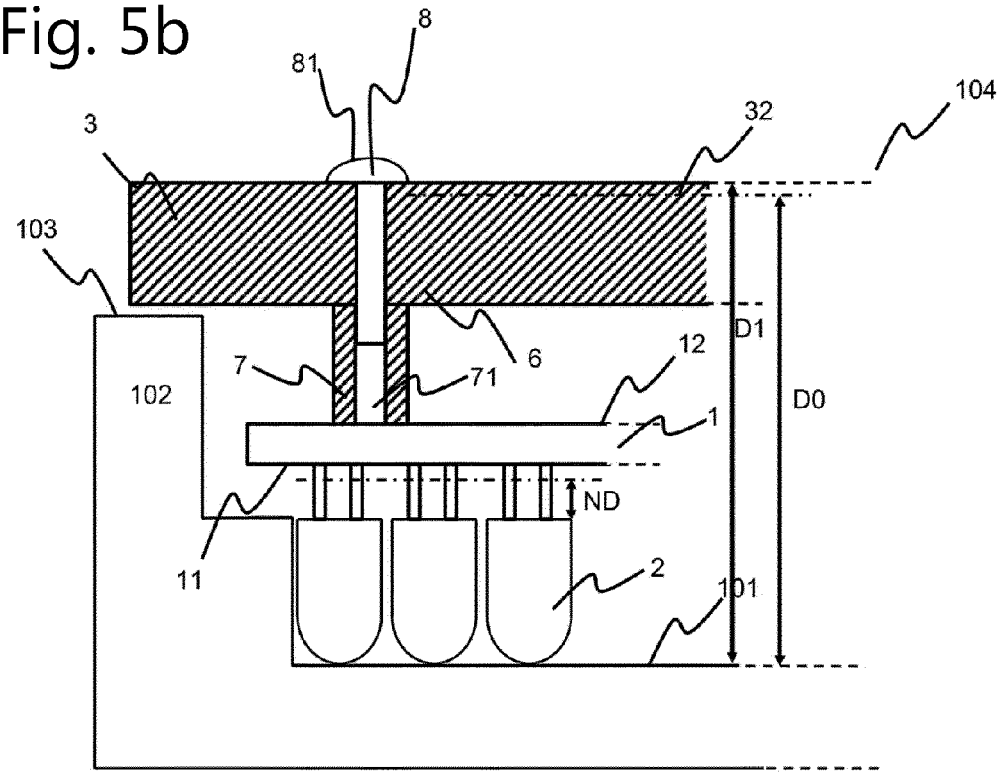

In FIG. 5*a*, the tops of the LEDs 2 are farther away from the first surface 11 of LED board 1 than nominal (nominal distance between the LED body and the LED board is figured as ND on FIGS. 4 to 6*b*).

If nothing were done about it (as on FIG. 5*b*), where the carrier board and the LED board are fastened together without the help of adjusting means 6, fastening the LED board 1 to the carrier board 3 without the adjusting means 6 would lead to a distance D1 between the back of the carrier board 3 and the tops of LEDs 2 larger than the desired distance D0.

The difference between D1 and D0 can be compensated for by the adjusting means 6 as follows: the spacer 7 can enter the opening 33; and the adjusting means 6 sliding into opening 33 follows the spacer 7 thereby compensating for the difference between the actual and nominal position of the LED 2 above the first surface 12 of the LED board. The position of adjusting means 6 is fixed with glue and the distance between the top of the LED 2 and the back 32 of the carrier board 3 is the desired D0.

Figure 6A:
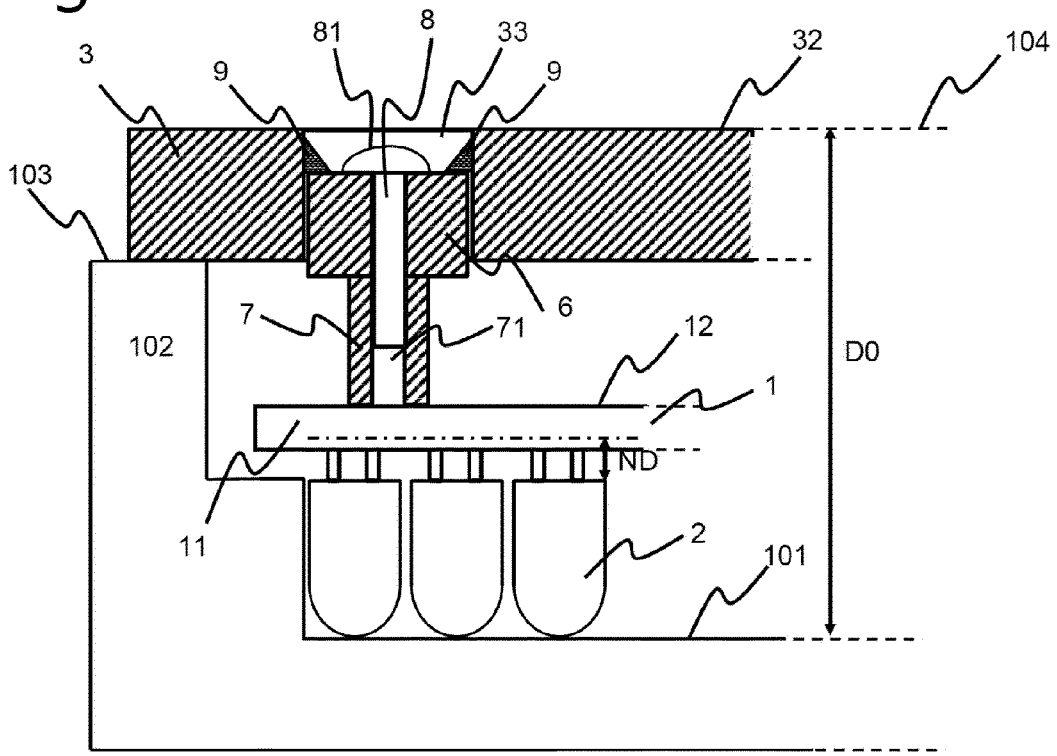
FIG. 6*a* shows a cross section of a display tile according to an embodiment of the invention when the top of the LED is closer the first surface 11 of LED board 1 than nominal

In FIG. 6*a*, the tops of the LEDs 2 are closer to the first surface 11 of LED board 1 than a nominal distance.

Figure 6B:
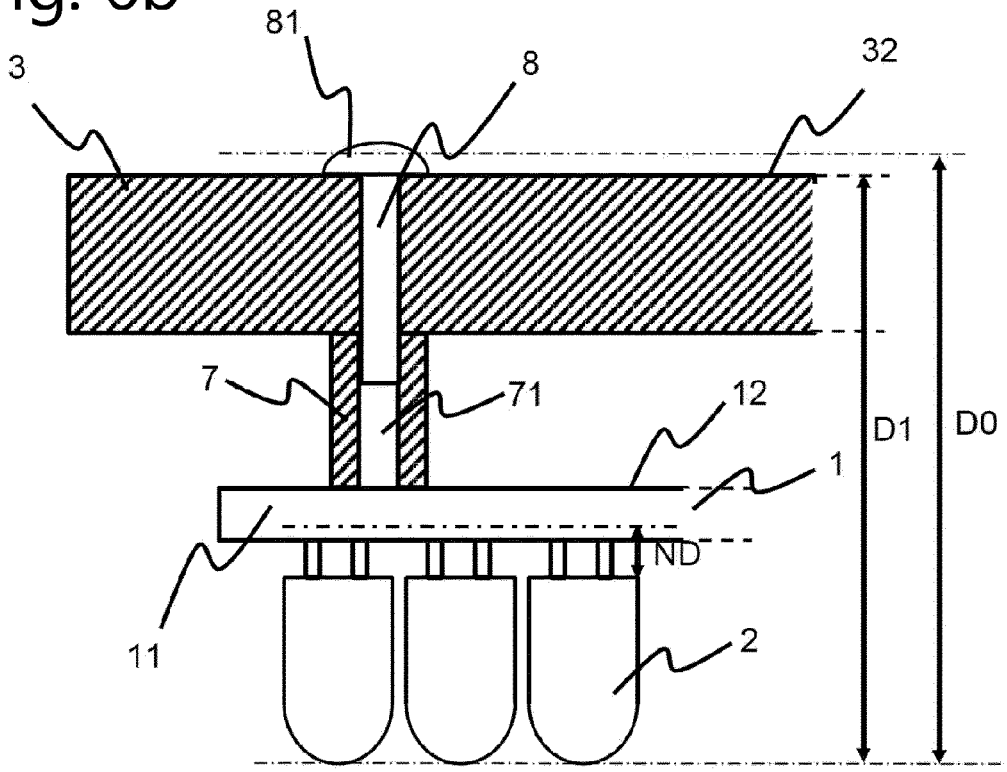

If nothing were done about it as on FIG. 6*b*, fastening the LED board 1 to the carrier board 3 without the adjusting means 6 would lead to a distance D1 between the back of the carrier board 3 and the top of LED 2 smaller than the desired distance D0.

The difference between D1 and D0 can be compensated for by the adjusting means 6 as follows: the spacer 7 does not intersect the plane of the first surface 31 of the carrier board 3 and the adjusting means 6 comes partially out of opening 33 (the first surface 61 is below the first surface 31) and stops when it contacts the spacer 7 compensating for the difference between the actual and nominal position of the LED 2 above the first surface 12 of the LED board. The position of adjusting means 6 is fixed with glue and the distance between the top of the LED 2 and the back of the carrier board 3 is the desired D0.

The LED board 1 can warp during manufacturing or manipulation. To compensate for this, pressure can be applied at several points of the second surface 12 of LED board 1 when it is positioned in a jig 10.

The top part 10B of the jig 10 is fastened to the bottom part 10A e.g. by means of screws. At least one threaded component 11 e.g. screws with a blunt end can be screwed through threaded openings in the top part 10B and pass through openings in the carrier board 3. The blunt ends 110 of the threaded components 11 straighten a warped LED board by applying pressure on at least one point of the LED board 1 and preferably 4 non collinear points of the second surface 12 of the LED board 1.

The invention claimed is:

1. A display tile comprising a display board and a carrier board, LED's being mounted on a first face of the display board and the carrier board being for attachment to a frame, the display board and the carrier board being fastened together by the intermediary of a spacer and an adjusting means positioned between the spacer and the carrier board wherein the adjusting means engage in an opening in the carrier board, the adjusting means allowing a compensation of the tolerances affecting the position of the LED's with respect to the carrier board in a direction perpendicular to the carrier board whereby the compensation is obtained by the position of the adjusting means in their corresponding opening, wherein the display board has LEDs and the distance between a first surface of the adjusting means and a first surface of the carrier board is set to the difference between a nominal distance and the sum of the distance between the tops of LEDs on the LED board and a second surface of the LED board, the length of the spacer, and the thickness of the carrier board, wherein the nominal distance is the distance between the top of the LEDs and the second surface of the carrier board or back of the carrier board.

2. The display tile according to claim 1, wherein a sidewall of the opening in the carrier board is perpendicular to the second surface of the carrier board.

3. The display tile according to claim 1, wherein a sidewall of the adjusting means is parallel to the sidewall of the opening in the carrier board.

4. The display tile according to claim 1, wherein the thickness of the adjusting means is less than the thickness of the carrier board.

5. The display tile according to claim 1, wherein the adjusting means is selected from:

being fastened to the carrier board by glue extending on a second surface and/or a sidewall of the adjusting means and a sidewall of the opening, and having a first part that is a circular right cylinder with a first radius and a second part that is a circular right cylinder with a second radius smaller than the first radius.

6. The display tile according to claim 1, wherein a fastening means fastens the adjusting means to the spacer.

7. The display tile according to claim 6, wherein the fastening means is selected from going through an opening in the adjusting means, and being a screw.

8. The display tile according to claim 1, wherein a threaded extension extends from the first surface of the adjusting means and that the spacer has a matching threaded opening to receive the threaded extension.

9. The display tile according to claim 8, wherein the second surface of the adjusting means is a driving surface.

10. A tiled display apparatus comprising a plurality of display tiles according to claim 1 fixed to a frame.

11. A method to adjust the distance between the tops of the LEDs on a first surface of a LED board on a display tile and the back surface of the carrier board of the display tile, the method comprising the steps:

positioning the tops of the LEDs on a LED board in a first reference plane, aligning openings in the carrier board with spacers distributed on the LED board, positioning a second surface of a carrier board in a second reference plane; a first surface of the carrier board facing a second surface of the LED board; the first and second reference planes being parallel and the distance between the first and second reference planes being equal to a desired nominal distance, moving adjusting means in the openings until a first surface of each adjusting means contacts a spacer, fastening each adjusting means to its corresponding spacer, fastening the adjusting means to the carrier board, wherein moving the adjusting means comprises changing the position of the adjusting means in the openings until the distance between the first surface of the adjusting means and the first surface of the carrier board is set to the difference between the nominal distance and the sum of the distance between the tops of LEDs on the LED board and a second surface of the LED board, the length of the spacer, and the thickness of the carrier board, and wherein the desired nominal distance is the distance between the top of the LEDs and the second surface of the carrier board or back of the carrier board.

12. The method of claim 11, wherein glue is dispensed in the openings, on sidewalls of the openings and on a second surface of the adjusting means.

13. The method of claim 12, wherein the glue is allowed to harden, to set or to cure to fasten the adjusting means to the carrier board at the position where the adjusting means compensates for the tolerances affecting the position of the LEDs with respect to the carrier board in a direction perpendicular to the carrier board.

14. The method of claim 12, wherein the height of the sidewalls is selected such that when the sidewalls are in contact with the carrier board, the distance between the second surface of the carrier board facing away from the reference surface and the reference surface is equal to the desired nominal distance between the tops of the LEDs on the LED board and the second surface of the carrier board.

15. The method of claim 12, wherein the adjusting means and the spacer are fastened by glue being dispensed in the openings to fasten the adjusting means to the carrier board and to fix its position in the openings, thereby guaranteeing that when the carrier board and LED board are taken out of the jig, the distance between the second surface of the carrier board and the tops of the LEDs is equal to the desired nominal distance.

16. The method of claim 12, wherein the distance between the top of the outermost part to which the sidewall extends and the reference surface in a direction perpendicular to the reference surface is made equal to the desired nominal distance.

17. The method of claim 12, wherein a flexible material is positioned between the top of the innermost part of the sidewall and the carrier board.

18. The method of claim 17, wherein the thickness of the flexible material is selected so that pressure applied to the carrier board makes the second surface of the carrier board flush or coplanar with the top of the outermost part of the sidewall of the jig.

19. The method of claim 18, wherein when the second surface of the carrier board is flush with the top of the outermost part of the sidewall of the jig, the distance between the tops of the LED and the second surface of the carrier board is made to be the desired nominal distance.

20. The method of claim 11, wherein the fixing of the distance between the top of the LEDs and the second surface of the carrier board is facilitated by using a jig manufactured with better tolerances than the LED board and the carrier board.

21. The method of claim 20, wherein the jig has a first surface or reference surface and sidewalls that extend from the first surface of the jig, the method further comprising if the tolerance on the thickness of the carrier board is sufficiently small to be neglected, the top of the sidewalls serves as a support or stop for the carrier board that is positioned in parallel with the reference surface.

22. The method of claim 21, wherein the LED board is positioned with the LEDs in contact with the reference surface.

23. The method of claim 11, wherein the position of the adjusting means in the opening of the carrier board is modified until a first surface of the adjusting means contacts the spacer and the adjusting means and the spacer are then fastened.

24. The method of claim 11, wherein the sidewalls of the jig are provided with a step.

25. The method of claim 16, wherein the distance between the top of the innermost part of the sidewall and the reference surface is made less than the desired nominal distance minus the nominal thickness of the carrier board.

* * * * *